US006376454B1

(12) United States Patent
Eggersmann et al.

(10) Patent No.: US 6,376,454 B1
(45) Date of Patent: Apr. 23, 2002

(54) DETERGENT COMPONENT OR COMPOSITION WITH PROTECTIVE COATING

(75) Inventors: Markus Eggersmann, Warendorf (DE); Zoë McKee, Newcastle; Koen Mariette Albert Schamp, Whitley Bay, both of (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/230,434

(22) PCT Filed: Jul. 1, 1997

(86) PCT No.: PCT/US97/11385

§ 371 Date: Jan. 25, 1999

§ 102(e) Date: Jan. 25, 1999

(87) PCT Pub. No.: WO98/03620

PCT Pub. Date: Jan. 29, 1998

(30) Foreign Application Priority Data

Jul. 23, 1996 (EP) ..... 96305381

(51) Int. Cl.[7] ..... C11D 17/00; C11D 3/12; C11D 3/22

(52) U.S. Cl. ..... 510/441; 510/312; 510/313; 510/349; 510/360; 510/376; 510/470; 510/473; 510/507; 510/511

(58) Field of Search ..... 510/441, 312, 510/313, 349, 350, 346, 470, 360, 473, 502, 511, 505, 507

(56) References Cited

U.S. PATENT DOCUMENTS

| | | | | |
|---|---|---|---|---|
| 4,009,113 A | | 2/1977 | Green et al. | 252/95 |
| 4,444,674 A | | 4/1984 | Gray | 252/95 |
| 4,545,784 A | | 10/1985 | Sanderson | 8/107 |
| 4,731,195 A | | 3/1988 | Olson | 252/174.13 |
| 5,318,714 A | * | 6/1994 | Markussen et al. | 510/374 |
| 5,324,444 A | | 6/1994 | Berry et al. | 252/174.11 |
| 5,458,801 A | | 10/1995 | Oyashiki et al. | 252/186.25 |
| 5,468,516 A | | 11/1995 | Yamashita et al. | 427/180 |
| 5,512,699 A | | 4/1996 | Connor et al. | 564/153 |
| 5,648,328 A | | 7/1997 | Angell et al. | 510/441 |
| 5,773,399 A | * | 6/1998 | Baillely et al. | 510/315 |
| 5,919,747 A | * | 7/1999 | Kazuta et al. | 510/444 |

FOREIGN PATENT DOCUMENTS

| | | |
|---|---|---|
| JP | 1-161097 | 6/1989 |
| JP | 3-111497 | 5/1991 |
| JP | 4-345700 | 12/1992 |
| JP | 5-32998 | 2/1993 |
| JP | 5-125400 | 5/1993 |
| JP | 63-12467 | 1/1998 |

* cited by examiner

*Primary Examiner*—Lorna M. Douyon
(74) *Attorney, Agent, or Firm*—Marianne Dressman; Kim William Zerby; Steven W. Miller

(57) ABSTRACT

Coatings are applied to particulate detergent components or compositions to improve free-flow properties, improve dispensing and avoid dust formation. This is achieved by a two-step coating process, wherein the first coating step comprises mixing the detergent composition or component with a finely divided particulate material which is preferably aluminosilicate, and the second coating step comprises applying a coating agent. Suitable coating agents for the second step comprise from 5% to 95% by weight of cellulosic polymer; from 5% to 95%, by weight of sugar; and optionally, from 0% to 30% by weight of plasticizer.

8 Claims, No Drawings

DETERGENT COMPONENT OR COMPOSITION WITH PROTECTIVE COATING

The present invention relates to the field of coated particulate detergent components or compositions.

It is known that the flow properties of granular detergents can be improved by "dusting" them with finely divided particulates, such as zeolite. U.S. Pat. No. 3,868,336 discloses detergent compositions dusted with from 0.5% to 15% by weight of water-insoluble flow-promoting agents. However, dusting with finely divided particulates does not provide any benefit for detergent dispensing, it can also make the final detergent product dusty, and it does not always provide adequate improvements in the flow properties.

Other coating agents, applied as liquids, melts or solutions are also known in the field of detergents. GB-A-1 395 006, published on May 21, 1975, discloses cellulosic polymers as coating agents for detergent components. Sucrose and glucose are also disclosed therein, as plasticizers with dextrin. However cellulosic polymers and sugars are nowhere disclosed in combination as coating agents for detergent components.

The disadvantage of coating a detergent with cellulosic polymer on its own is that the film formed is slow to dry, and can form a coating that is sticky.

Mixtures of cellulosic polymers and sugars are known coating agents in the pharmaceutical field. JP-51 123 815, published Oct. 29, 1976, and EP-A-0 551 700, published on Jul. 21, 1993 both disclose combinations of cellulosic polymer and sugars as coating agents for pharmaceutical products, but there is no suggestion that these coatings are suitable for use with detergents.

The object of the present invention relates the application of certain coatings to particulate detergent components or compositions to improve free-flow properties, improve dispensing, avoid dust formation and improve stability of storage sensitive materials.

A further object of the present invention is to provide a fast-drying coating which forms a continuous film around the particles of the detergent component or composition.

SUMMARY OF THE INVENTION

The object of the invention is achieved by a two-step coating process, wherein the first coating step comprises the process of mixing the detergent composition or component with a finely divided particulate material which is preferably aluminosilicate, and the second coating step comprises the process of applying a coating agent. Suitable coating agents comprise from 5% to 95%, preferably from 10% to 60% by weight of cellulosic polymer; from 5% to 95%, preferably from 60% to 90% by weight of sugar; and optionally, from 1% to 30% by weight of plasticizer.

Preferred detergent components include nonionic surfactant, in particular polyhydroxy fatty acid amide; and bleach activators.

DETAILED DESCRIPTION OF THE INVENTION

The term "cellulosic polymer" as used herein means polymers that are built up from derivatives of cellulose. Cellulose is a polysaccharide made from β-D-glucose units linked together. In the derivatives one or more of the hydroxyl groups are replaced by other groups e.g. methyl, ethyl, propyl.

Preferred cellulosic polymers include methyl cellulose, ethyl cellulose, hydroxymethyl cellulose, hydroxyethyl cellulose, hydroxypropyl cellulose, methylhydroxymethyl cellulose, methylhydroxyethyl cellulose, methylhydroxypropyl cellulose and ethyl hydroxyethyl cellulose.

The term "sugar" as used herein is a generic term for a class of carbohydrates which are usually crystalline and sweet by nature, and which are water soluble. Sugars are formed form glucose and fructose units which are sugars in their own right. Preferred sugars include glucose, fructose, galactose, sucrose, maltose, lactose, sorbitol, manitol, rafinose, trehalose.

The term "plasticizer" as used herein is a material that is added to the original material for the purpose of softening the original material, and make it more flexible. Preferred plastisrzers include polyethylene glycol having a molecular weight of between 200 and 20000, polypropylene glycol, glycerol, triacetin The second coating agent may be applied in any conventional coating apparatus. Suitable apparatus include pan coater; rotating drum continuous coater; spray fluidised granular, or spray fluidised continuous belt. In a particular embodiment of the present invention the components of the second coating agent are dissolved or dispersed in a suitable solvent or carrier medium. A preferred solvent is water, and an aqueous solution may be prepared which is typically 5% to 40% solids.

The solution or dispersion may then be sprayed on to the detergent component or composition. The proportion of the second coating agent needed to provide a suitable coating layer depends on various parameters, such as the surface characteristics of the detergent component or composition, and will be easily determined by experiment. Preferably the second coating agent is from 0.1% to 30% of the finished product, more preferably, from 1% to 5%, and most preferably about 2%.

In the present invention, the detergent component or composition is coated with a finely divided particulate material prior to coating with the second coating agent.

The detergent component or composition is coated with a first coating agent comprising up to 35%, preferably from 1% to 20% by weight of finely divided particulate material prior to the application of the second coating agent. The first coating agent has two purposes. Firstly it allows the detergent particles to be separated (if they are sticky) so that each one can be fully coated. Secondly it gets combined into the second coating agent and adds additional structure to the coating.

Finely divided particulate materials useful herein include aluminosilicates having the empirical formula:

$$M_z(zAlO_2)_y]\cdot x\ H_2O$$

wherein z and y are integers of at least 6, the molar ratio of z to y is in the range from 1.0 to about 0.5, and x is an integer from about 15 to about 264. Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations zeolite A, zeolite P(B), zeolite MAP, zeolite X and zeolite Y. In an especially preferred embodiment, the crystalline aluminosilicate ion exchange material has the formula:

$$Na_{12}[(AlO_2)_{12}(SiO_2)_{12}]\cdot x\ H_2O$$

wherein x is from about 20 to about 30, especially about 27. This material is known as zeolite A. Dehydrated zeolites (x=0–10), and "overdried" zeolites (x=10–20) may also be used herein. The "overdried" zeolites are particularly useful when a low moisture environment is required, for example to improve stability of detergent bleaches such as perborate and percarbonate. Preferably, the aluminosilicate has a particle size of about 0.1–10 micrometers in diameter. Preferred ion exchange materials have a particle size diameter of from about 0.2 micrometers to about 4 micrometers. The term "particle size diameter" herein represents the average particle size diameter by weight of a given ion exchange material as determined by conventional analytical techniques such as, for example, microscopic determination utilizing a scanning electron microscope. The crystalline zeolite A materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The zeolite A materials herein are still further characterized by their calcium ion exchange rate which is at least about 2 grains $Ca^{++}$/gallon/minute/gram/gallon (0.13 g $Ca^{++}$/litre/minute/gram/litre) of aluminosilicate (anhydrous basis), and generally lies within the range of from about 2 grains/gallon/minute/gram/gallon(0.13 g $Ca^{++}$/litre/minute/gram/litre) to about 6 grains/gallon/minute/gram/gallon (0.39 g $Ca^{++}$/litre/minute/gram/litre), based on calcium ion hardness. Optimum aluminosilicate for builder purposes exhibit a calcium ion exchange rate of at least about 4 Agrains/gallon/minute/gram/gallon (0.26 g $Ca^{++}$/litre/minute/gram/litre).

Other finely divided particulate materials include talc, silica and bentonite, as well as other clays.

Particulate Detergent Components or Compositions

Detergent components or compositions are conventionally processed into particulate form in one of a number of ways. Spray-drying is one such process which has been widely practised for may decades. More recently dry neutralisation, agglomeration, extrusion, granulation in fluidised beds, flaking, encapsulation, prilling, pastillation and other processes have also been used.

Detergent compositions and components typically comprise surfactants, builders, chelants, bleach, bleach activators, enzymes, enzyme stabilisers, soil release agents, brightener, suds suppressor, fabric softener, antiredeposition agents and mixtures of these. The present invention is particularly suitable for use with nonionic or cationic surfactants, or with bleach activators.

Preferred nonionic surfactants for use in the present invention include two families of nonionics which have been found to be particularly useful. These are nonionic surfactants based on alkoxylated (especially ethoxylated) alcohols, and those nonionic surfactants based on amidation products of fatty acid esters and N-alkyl polyhydroxy amine. The amidation products of the esters and the amines are generally referred to herein as polyhydroxy fatty acid amides. Particularly useful in the present invention are mixtures comprising two or more nonionic surfactants wherein at least one nonionic surfactant is selected from each of the groups of alkoxylated alcohols and the polyhydroxy fatty acid amides.

Suitable nonionic surfactants include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Particularly preferred for use in the present invention are nonionic surfactants such as the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with an average of up to 25 moles of ethylene oxide per more of alcohol. Particularly preferred are the condensation products of alcohols having an alkyl group containing from about 9 to 15 carbon atoms with from about 2 to 10 moles of ethylene oxide per mole of alcohol; and condensation products of propylene glycol with ethylene oxide. Most preferred are condensation products of alcohols having an alkyl group containing from about 12 to 15 carbon atoms with an average of about 3 moles of ethylene oxide per mole of alcohol.

It is a particularly preferred embodiment of the present invention that the nonionic surfactant system also includes a polyhydroxy fatty acid amide component.

Polyhydroxy fatty acid amides may be produced by reacting a fatty acid ester and an N-alkyl polyhydroxy amine. The preferred amine for use in the present invention is N-(R1)-CH2(CH2OH)4-CH2-OH, where R1 is typically a alkyl, e.g. methyl group; and the preferred ester is a C12–C20 fatty acid methyl ester.

Methods of manufacturing polyhydroxy fatty acid amides have been described in WO 92 6073, published on Apr. 16, 1992. This application describes the preparation of polyhydroxy fatty acid amides in the presence of solvents. In a highly preferred embodiment of the invention N-methyl glucamine is reacted with a C12–C20 methyl ester.

Other nonionic surfactants which may be used as components of the surfactant systems herein include ethoxylated nonionic surfactants, glycerol ethers, glucosamides, glycerol amides, glycerol esters, fatty acids, fatty acid esters, fatty amides, alkyl polyglucosides, alkyl polyglycol ethers, polyethylene glycols, ethoxylated alkyl phenols and mixtures thereof.

The present invention is particularly useful with bleach activators. For hygiene reasons, the inhalation of many bleach activators should be avoided, so dusty products should be avoided. The present invention provides a means for minimising or eliminating dust formation by providing an effective coating.

Particularly suitable bleach activators are caproyl oxybenzene sulfonate; $N,N,N^1N^1$ tetra acetylated compounds; benzoyloxybenzene sulphonate; benzoyl caprolactam; and mixtures thereof. Most suitable bleach activators are (6-octanamido-caproyl)oxybenzenesulfonate, (6-nonanamido-caproyl) oxy benzene sulfonate, (6-decanamido-caproyl)oxybenzenesulfonate, and mixtures thereof.

EXAMPLE 1

| | % by weight |
|---|---|
| Poly hydroxy fatty acid amide | 49 |
| Nonionic surfactant (AE5) | 22 |
| Hydrogenated fatty acid | 17 |
| First coating agent - Zeolite A | 10 |
| Second coating agent | 2 |

A molten mixture consisting of the nonionic surfactants polyhydroxy fatty acid amide, ethoxylated alcohol and the hydrogenated fatty acid was prepared. Micropastilles of the molten mixture were then made by forming drops of the molten material on a cold steel belt, where they solidify. Apparatus for carrying out micropastillation is commercially available from Sandvik.

The micropastilles were then coated first with the zeolite (10% by weight), and subsequently coated with the coating agent which was an aqueous solution with a solids content of 15%, the solids content comprising hydroxy propyl methyl cellulose (35 parts), lactose (45 parts), and triacetin (20 parts).

The first coating of zeolite was applied in a concrete mixer to ensure good distribution of the flow aid. The second coating agent was applied by spraying the aqueous coating in a spray fluid bed granulator. The aqueous coating was sprayed onto the particles, and warm air was used to dry off the excess water.

EXAMPLE 2

| | % by weight |
|---|---|
| NACA-OBS | 68 |
| Citric acid | 10 |
| Anionic surfactant (AE3S) | 5 |
| Maleic-acrylic copolymer | 5 |
| Water | 2 |
| First coating agent - Zeolite A | 5 |
| Second coating agent | 5 |

NACA-OBS is nonyl amido caproyl oxy benzene sulphonate which is a bleach activator.

AE3S is alkyl ether sulphate (with 3 EO groups per molecule).

A detergent component comprising the bleach activator, citric acid, anionic surfactant, copolymer and water was prepared by mixing the dry materials and binders and passing the mixture through an extruder forming noodles of materials. These noodles are allowed to drop into a spheroniser (a Marumeriser® having a rotating bowl with a friction plate) which shapes beads of the desired size.

The beads were then coated first with the zeolite (5% by weight), and subsequently coated with the second coating agent which was an aqueous solution with a solids content of 15%, the solids content comprising hydroxy propyl methyl cellulose (35 parts), lactose (45 parts), and triacetin (20 parts). The coating was applied in a fluid bed granulator.

EXAMPLE 3

| | % by weight |
|---|---|
| Poly hydroxy fatty acid amide | 6 |
| Nonionic surfactant (AE5) | 18 |
| Hydrogenated fatty acid | 3 |
| Glycerol Tristearate | 1 |
| Zeolite A | 56 |
| Carbonate | 6 |
| First coating agent - Zeolite A | 5 |
| Second coating agent | 5 |

A molten mixture consisting of the nonionic surfactants polyhydroxy fatty acid amide, ethoxylated alcohol, hydrogenated fatty acid and glycerol tristearate was prepared. This paste was cooled and agglomerated in a CB Loedige® with the zeolite and carbonate. The finished agglomerates were dusted with additional zeolite in a KM Loedige®.

The agglomerates were subsequently coated with the second coating agent which was an aqueous solution with a solids content of 40%, the solids content comprising hydroxy propyl methyl cellulose (10 parts), lactose (45 parts), and sucrose (45 parts).

The second coating agent was applied by spraying the aqueous coating in a spray fluid bed granulator. The aqueous coating was sprayed onto the particles, and warm air was used to dry off the excess water.

What is claimed is:

1. A detergent composition or component in the form of particles, the detergent composition or component being coated by a two-step coating process, wherein the first coating step comprises the process of mixing the detergent composition or component with a finely divided particulate material selected from the group consisting of aluminosilicates, talc, silica and clays, whereby the particles of said detergent composition or component are separated; and wherein the second coating step comprises the process of applying a second coating agent to the coated detergent composition or component of the first step, the second coating agent comprising:

(i) from 5% to 95% by weight of a cellulosic polymer;

(ii) from 5% to 95% by weight of a sugar; and (iii) from 1% to 30% by weight of a plasticizer.

2. A particulate detergent composition or component according to claim 1 wherein the coating agent applied in the second coating step comprises:

(i) from 10% to 60% by weight of a cellulosic polymer;

(ii) from 60% to 90% by weight of a sugar; and (iii) from 1% to 30% by weight of a plasticizer.

3. A particulate detergent composition or component according to claim 1 wherein the finely divided particulate material in the first coating step is aluminosilicate.

4. A detergent composition or component according to claim 1 wherein the coating agent comprises cellulosic polymers selected from the group consisting of methyl cellulose, ethyl cellulose, hydroxymethyl cellulose, hydroxyethyl cellulose, hydroxypropyl cellulose, methylhydroxymethyl cellulose, methylhydroxyethyl cellulose, methylhydroxypropyl cellulose, ethyl hydroxyethyl cellulose and mixtures thereof.

5. A detergent composition or component according to claim 1 wherein the coating agent comprises sugar selected from the group consisting of sucrose, glucose, lactose, fructose, sorbitol, rafinose, trehalose, galactose, maltose, mannitol and mixtures thereof.

6. A detergent composition or component according to claim 1 wherein the plasticizer is selected from the group consisting of polyethylene glycol having a molecular weight of between 200 and 20000, polypropylene glycol, glycerol, triacetin and mixtures thereof.

7. A detergent composition or component according to claim 1 wherein the detergent component or composition comprises nonionic surfactant.

8. A detergent composition or component according to claim 1 wherein the detergent component or composition comprises bleach activator selected from the group Consisting of caproyl oxybenzene sulfonate; N,N,$N^1N^1$ tetra acetylated compounds; (6-octanamido-caproyl) oxybenzenesulfonate, (6-nonanamidocaproyl)oxy benzene sulfonate, (6-decanamido-caproyl)oxybenzenesulfonate; benzoyl caprolactam, and mixtures thereof.

* * * * *